US009123349B2

(12) United States Patent
de la Guardia Gonzales

(10) Patent No.: US 9,123,349 B2
(45) Date of Patent: Sep. 1, 2015

(54) METHODS AND APPARATUS TO PROVIDE SPEECH PRIVACY

(71) Applicant: Rafael de la Guardia Gonzales, Zapopan (MX)

(72) Inventor: Rafael de la Guardia Gonzales, Zapopan (MX)

(73) Assignee: INTEL CORPORATION, Santa Clara, CA (US)

( * ) Notice: Subject to any disclaimer, the term of this patent is extended or adjusted under 35 U.S.C. 154(b) by 190 days.

(21) Appl. No.: 13/630,615

(22) Filed: Sep. 28, 2012

(65) Prior Publication Data

US 2014/0095153 A1 Apr. 3, 2014

(51) Int. Cl.

| | |
|---|---|
| ***G10L 21/00*** | (2013.01) |
| ***G10L 19/00*** | (2013.01) |
| ***G10L 25/48*** | (2013.01) |
| *G10L 21/06* | (2013.01) |

(52) U.S. Cl.
CPC *G10L 25/48* (2013.01); *G10L 21/06* (2013.01)

(58) Field of Classification Search
CPC .... G10L 13/033; G10L 13/0333; G10L 21/06
See application file for complete search history.

(56) References Cited

U.S. PATENT DOCUMENTS

| | | | | |
|---|---|---|---|---|
| 4,133,977 | A * | 1/1979 | McGuire et al. | 380/253 |
| 6,690,800 | B2 * | 2/2004 | Resnick | 381/73.1 |
| 7,143,028 | B2 * | 11/2006 | Hillis et al. | 704/203 |
| 7,761,292 | B2 * | 7/2010 | Ferencz et al. | 704/226 |
| 8,140,326 | B2 * | 3/2012 | Chen et al. | 704/226 |
| 2004/0019479 | A1 * | 1/2004 | Hillis et al. | 704/200.1 |
| 2004/0125922 | A1 * | 7/2004 | Specht | 379/88.01 |
| 2006/0109983 | A1 * | 5/2006 | Young et al. | 380/252 |
| 2006/0247919 | A1 * | 11/2006 | Specht et al. | 704/201 |
| 2007/0083361 | A1 * | 4/2007 | Ferencz et al. | 704/201 |
| 2009/0306988 | A1 * | 12/2009 | Chen et al. | 704/261 |
| 2012/0053931 | A1 * | 3/2012 | Holzrichter | 704/200.1 |
| 2012/0316869 | A1 * | 12/2012 | Xiang et al. | 704/226 |
| 2014/0006017 | A1 * | 1/2014 | Sen | 704/208 |

* cited by examiner

*Primary Examiner* — Matthew Baker
(74) *Attorney, Agent, or Firm* — Hanley, Flight & Zimmerman, LLC

(57) ABSTRACT

Methods and apparatus to provide speech privacy are disclosed. An example method includes forming a sampling block based on a first received audio sample, the sampling block representing speech of a user, creating, with a processor, a mask based on the sampling block, the mask to reduce the intelligibility of the speech of the user, wherein the mask is created by converting the sampling block from a time domain to a frequency domain to form a frequency domain sampling block, identifying a first peak within the frequency domain sampling block, demodulating the frequency domain sampling block at the first peak to form a first envelope of the sampling block, distorting the first envelope to form a first distorted envelope, and emitting an acoustic representation of the mask via a speaker.

20 Claims, 6 Drawing Sheets

METHODS AND APPARATUS TO PROVIDE SPEECH PRIVACY

FIELD OF THE DISCLOSURE

This disclosure relates generally to privacy, and, more particularly, to methods and apparatus to provide speech privacy.

BACKGROUND

Speech privacy is important for people when communicating information on telephones and/or mobile devices. Users expect that their speech is not heard by an eavesdropper. In some examples, encryption can be used to prevent eavesdroppers listening in on the communication while it is being transmitted via a network (e.g., a cellular network) from understanding the communication.

DETAILED DESCRIPTION

Figure 1:
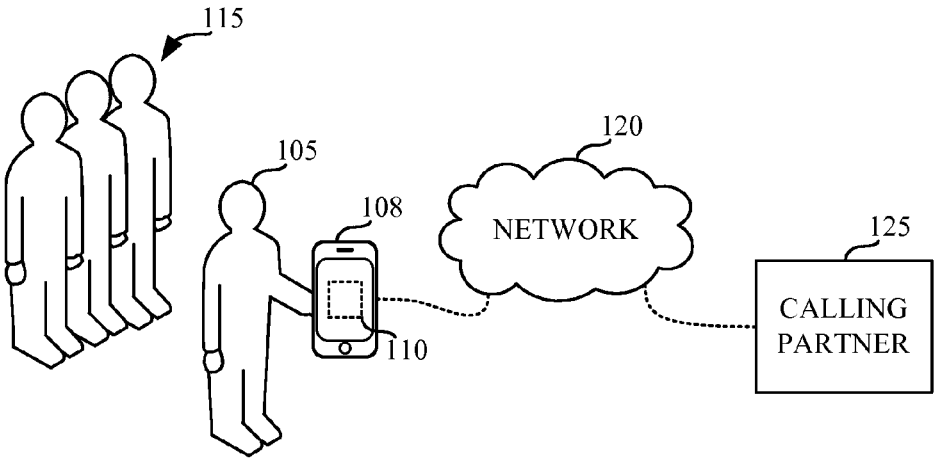
FIG. 1 is a diagram of an example field of use of an example speech privacy engine.

Speech privacy is important for people who wish to communicate sensitive information. For example, while speaking on a mobile device a user may wish to inform a calling partner (e.g., a person on the other end of a telephone call) of sensitive information (e.g., a credit card number, a social security number, a password, etc.). Electronic measures such as encryption may be used to prevent another party (e.g., an eavesdropper) from listening in on and/or otherwise understanding the communication between the mobile device and the calling partner. Users of mobile devices and/or telephones have had to prevent their communications from being heard by eavesdroppers by, for example, lowering their voices, isolating themselves from others, hoping they are not overheard, and/or refraining from communicating their sensitive information until another time and/or location in which such communications may occur without risk. As used herein, an eavesdropper includes any human and/or listening device (e.g., a microphone) that is not using the speech privacy engine, but may perceive and/or otherwise receive audio signals from a user of the speech privacy engine, whether intentional or not.

In acoustics and signal processing, a speech masker is a signal that interferes with a speech signal coming from an audio source such as, for example, a person talking on a telephone. In some examples, the speech masker includes synthetic tones, broadband noise, speech from other talkers, etc. In the examples described herein, the speech masker is produced by a loudspeaker of the telephone. Accordingly, a user of the telephone may record messages and/or make phone calls without their speech being understood by eavesdroppers that are in a proximity of the telephone. Such eavesdroppers would hear the speech in addition to the speech masker, thereby making the speech unintelligible.

In examples illustrated herein, a speech mask is based on the speech of the user. In examples described herein, the speech of the user is referred to as a first speech sound. Accordingly, the speech mask has similar temporal and spectral characteristics as the speech of the user. Creating a speech mask that has similar temporal and spectral characteristics of the user reduces the likelihood an anomaly in the audio (e.g., the presence of the speech mask) will be detected by an eavesdropper. The speech mask is played via a speaker of the mobile device and is heard by an eavesdropper. Accordingly, to the eavesdropper, the speech appears to be coming from the user, but the intelligibility of the speech is substantially reduced. In some examples, the speech sounds like noise and/or non-existent vocabulary coming from the user instead of intelligible words.

Because the speech mask is transmitted into an area in proximity to the telephone, the microphone of the mobile device and/or telephone receives a second speech sound including the speech of the user (the first speech sound) and the speech mask. The speech mask is subtracted from the second speech sound resulting in a representation of the first speech sound, prior to transmission to the calling partner, thereby enabling the calling partner to understand the communication.

Example methods and apparatus described herein are not limited to mobile phones and/or land line phones, but may be implemented using any type of commercial handheld device (e.g., smartphones, personal digital assistants, etc.). Example methods and apparatus described herein result in a small amount of power consumption (typically less than four percent of the battery during daily use). Tests performed on the methods and apparatus described herein using a speech transmission index metric showed that speech intelligibility was reduced to less than twenty percent when the masking techniques were used (as measured by the percentage of words correctly identified in a sentence).

FIG. 1 is a diagram of an example field of use of an example speech privacy engine 110. In the illustrated example of FIG. 1, an example user 105 is speaking into the example speech privacy engine 110 that has been integrated into a mobile phone 108. The user of FIG. 1 is a person is speaking within a proximity of the speech privacy engine 110.

In the illustrated example of FIG. 1, the speech privacy engine 110 is implemented as a mobile device and/or telephone 108. However, in some examples, the speech privacy engine 110 is implemented as a speech recording device such as, for example, a digital audio recorder. In the illustrated example, the speech privacy engine 110 enables the user 105 to communicate their audible sensitive information to a calling partner 125 via a network 120 (e.g. a cellular and/or telephone network).

In the illustrated example of FIG. 1, the network 120 is a telephone network. However, any other network could additionally or alternatively be used. For example, some or all of the network 120 may be a company intranet network, a personal (e.g. home) network, the Internet, etc. Although the illustrated example of FIG. 1 communicates voice samples over the network 120, any data may be transmitted via the network 120, without limitation.

The example calling partner 125 of the illustrated example of FIG. 1 may be an entity that receives voice samples from the speech privacy engine 110 via the network 120. In the illustrated example of FIG. 1, the calling partner 125 is a person with which the user 105 is conducting a conversation. However, in some examples the calling partner 125 is implemented via an interactive voice response (IVR) system. Further, in some examples, the network 120 and/or the calling partner 125 may be omitted. For example, the speech privacy engine 110 may be implemented by a digital voice recorder such that, for example, instead of transmitting voice signals to another party, the speech privacy engine 110 records the speech received from user 105 in a memory of the speech privacy engine 110.

In the illustrated example of FIG. 1, eavesdroppers 115 are physically located near the user 105. However, the eavesdroppers 115 may be positioned in any location such that they are able to receive and/or otherwise hear the speech of the user 105. Because the eavesdroppers 115 are able to hear the speech of the user 105, the eavesdroppers 115 may hear sensitive and/or otherwise personal information communicated by the user 105. As described above, the example speech privacy engine 110 produces a speech mask that renders the speech of the user 105 unintelligible to the eavesdroppers 115.

Figure 2:
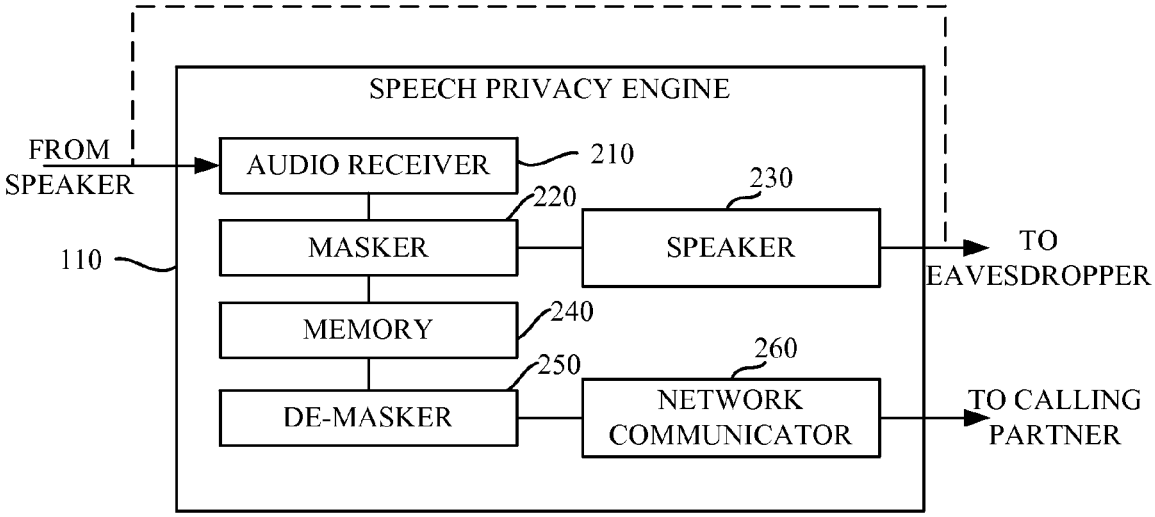
FIG. 2 is a block diagram of an example implementation of the speech privacy engine of FIG. 1.

FIG. 2 is a block diagram of the example speech privacy engine 110 of FIG. 1. The example speech privacy engine 110 of illustrated example of FIG. 2 includes an audio receiver 210, a masker 220, a speaker 230, a memory 240, a de-masker 250, and a network communicator 260.

The audio receiver 210 of the illustrated example of FIG. 2 is implemented by a microphone. However, any other device for receiving audio may additionally or alternatively be used. In the illustrated example of FIG. 2, the audio receiver 210 receives speech in the form of an audio signal from the user 105. The received audio is sampled and transmitted to the example masker 220 for processing.

The masker 220 of the illustrated example of FIG. 2 is implemented by a processor executing instructions, but it could alternatively be implemented by an application specific integrated circuit(s) (ASIC(s)), programmable logic device(s) (PLD(s)) and/or field programmable logic device(s) (FPLD(s)), or other analog and/or digital circuitry. In the illustrated example of FIG. 2, the masker 220 creates an audio mask based on the speech received via the audio receiver 210. The example masker 220 then causes the audio mask to be output via the speaker 230 so that the speech of the user is not intelligible by the eavesdroppers. In the illustrated example, the audio mask includes a phase-distorted version of one or more peaks of the frequency components of the speech of the user.

The speaker 230 of the illustrated example of FIG. 2 is implemented by a loudspeaker of the speech privacy engine 110. However, any other type of speaker may additionally or alternatively be used. In the illustrated example, the speaker 230 emits the audio mask received from the example masker 220 into the surrounding area of the speech privacy engine 110 such that, when heard by the eavesdropper 115 in combination with the speech of the user, the speech of the user is unintelligible.

The memory 240 of the illustrated example of FIG. 2 may be implemented by any device for storing data such as, for example, flash memory, magnetic media, optical media, etc. Furthermore, the data stored in the memory 240 may be in any data format such as, for example, binary data, comma delimited data, tab delimited data, structured query language (SQL) structures, etc. While in the illustrated example of FIG. 2 the memory 240 is illustrated as a single device, the memory 240 may be implemented by any number and/or type(s) of memories. In the illustrated example of FIG. 2, the memory 240 stores a representation of the speech mask created by the masker 220. In some examples, the memory 240 stores the audio sample received by the audio receiver 210 and/or the de-masked audio sample generated by the de-masker 250.

The de-masker 250 of the illustrated example of FIG. 2 may be implemented by a processor executing instructions, but it could alternatively be implemented by an ASIC, a PLD, or other analog and/or digital circuitry. In the illustrated example of FIG. 2, the de-masker 250 receives the audio from the audio receiver 210 and subtracts the speech mask stored in the memory 240 to form a clean audio sample. A clean audio sample is a representation of the speech of the user received by the audio receiver 210, not including the audio mask. In some examples, the clean audio sample is filtered and/or otherwise processed to more closely represent the speech of the user. In the illustrated example, the clean audio sample is transmitted by the network communicator 260 to the calling partner 125 via the network 120.

The network communicator 260 of the illustrated example of FIG. 2 is implemented by a cellular communicator, to allow the speech privacy engine 110 to communicate with a cellular telephone network (e.g., the network 120). However, additionally or alternatively, the network communicator 260 may be implemented by any other type of network interface such as, for example, an Ethernet interface, a Wi-Fi interface, a Bluetooth Interface, a landline interface, etc. In still other examples, the network communicator 260 may be eliminated in lieu of an input/output device interface. For example, the speech privacy engine 110 may be communicatively connected to a personal digital audio recorder, a video recorder, a tape recorder, etc. In some examples, the clean audio sample may be stored in the memory 240 such that the clean audio sample may be played back at a later time.

Figure 3:
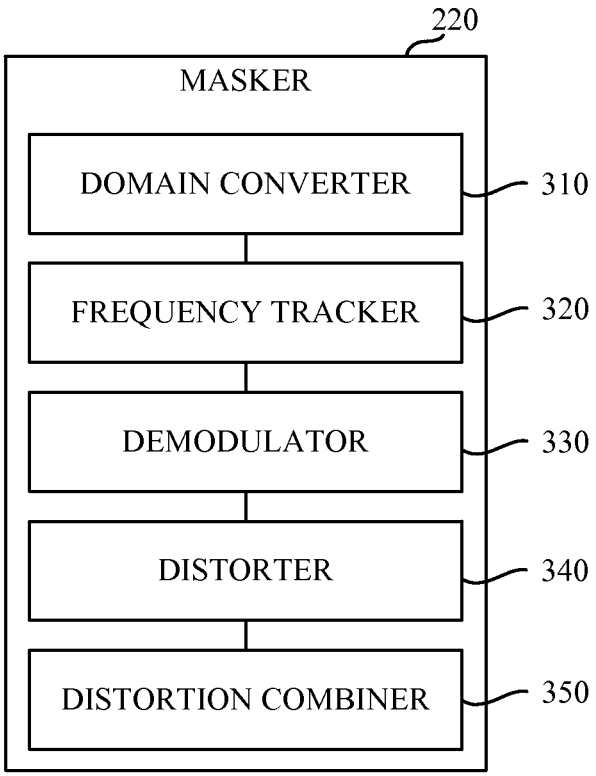
FIG. 3 is a block diagram of an example implementation of the masker of the speech privacy engine of FIGS. 1 and 2.

FIG. 3 is a block diagram of the example masker 220 of the speech privacy engine 110 of FIGS. 1 and 2. The example masker 220 includes a domain converter 310, a frequency tracker 320, a demodulator 330, a distorter 340, and a distortion combiner 350. Each of the example domain converter 310, the example frequency tracker 320, the example demodulator 330, the example distorter 340, and the example distortion combiner 350 may be implemented by one or more processors executing instructions, but they could alternatively be implemented by one or more ASIC(s), PLD(s), and/or other analog and/or digital circuit(s).

In the illustrated example of FIG. 3, the example domain converter 310 converts the audio sample received by via the audio receiver 210 into a frequency domain sample. In the illustrated example of FIG. 3, the domain converter 310 implements a short time Fourier transform (SFFT) to perform the conversion. However any other method of converting time domain samples (e.g., the audio sample) into frequency domain samples may additionally or alternatively be used such as, for example, a discrete Fourier transform (DFT), a fast Fourier transform (FFT), a sparse fast Fourier transform (SFFT), etc.

In the illustrated example of FIG. 3, the frequency tracker 320 identifies one or more peaks in the frequency domain samples generated by the domain converter 310. The peaks identified by the example frequency tracker 320 represent harmonics of the frequency domain samples. However, any other point in the frequency domain samples may additionally or alternatively be used such as, for example, peaks other than harmonics, valleys, etc. A harmonic is a component frequency of the audio that is an integer multiple of the fundamental frequency of the audio sample. In the illustrated example, the frequency tracker 320 identifies the first three harmonics of the frequency domain samples. However, other numbers of harmonics may additionally or alternatively be used. The identified peaks are refined using a conditional mean frequency technique. In some examples, refining the identified peaks results in a more accurate tracking of the peaks. More accurately tracked peaks results in a speech mask that more closely resembles the speech formants and/or spectral characteristics of the speech of the user. However, any other method of refining the identification of the peaks in the frequency domain samples may additionally or alternatively be used.

In the illustrated example of FIG. 3, the demodulator 330 demodulates the frequency domain samples using the peaks identified by the frequency tracker 320. The example demodulator 330 applies a Hilbert transformation to obtain a demodulated sample for each peak representing a complex amplitude and frequency at the respective peak identified by the frequency tracker 320. In some examples, coherent demodulation techniques are used to demodulate the frequency domain samples. The complex amplitude and frequency at each peak may represent an envelope of one or more harmonics of the voice samples received by the example audio receiver 210.

In the illustrated example of FIG. 3, the distorter 340 distorts the demodulated samples by introducing a phase shift at the same amplitude and frequency as the complex amplitude and frequency of each of the demodulated samples to form distorted samples. A different phase shift may be used for each complex amplitude and frequency. However, in some examples, a same phase shift may be used for each complex amplitude and frequency.

In the illustrated example of FIG. 3, the distortion combiner 350 combines the distorted samples to form a mask sample. Once combined, the mask sample is emitted by the example speaker 230 such that it is combined with the voice of the user. The mask sample preserves and/or otherwise maintains the envelope and speech formants (e.g., spectral characteristics) of the voice of the user, but reduces intelligibility of the voice.

While an example manner of implementing the speech privacy engine 110 of FIG. 1 has been illustrated in FIGS. 2 and/or 3, one or more of the elements, processes, and/or devices illustrated in FIGS. 2 and/or 3 may be combined, divided, re-arranged, omitted, eliminated, and/or implemented in any other way. Further, while an example manner of implementing the example masker 220 of FIG. 2 has been illustrated in FIG. 3, one or more of the elements, processes and/or devices illustrated in FIG. 3 may be combined, divided, re-arranged, omitted, eliminated and/or implemented in any other way. Further, the example audio receiver 210, the example masker 220, the example domain converter 310, the example frequency tracker 320, the example demodulator 330, the example distorter 340, the example distortion combiner 350, the example speaker 230, the example memory 240, the example de-masker 250, the example network communicator 260, and/or, more generally, the example speech privacy engine 110 of FIGS. 1, 2, and/or 3 may be implemented by hardware, software, firmware and/or any combination of hardware, software and/or firmware. Thus, for example, any of the example audio receiver 210, the example masker 220, the example domain converter 310, the example frequency tracker 320, the example demodulator 330, the example distorter 340, the example distortion combiner 350, the example speaker 230, the example memory 240, the example de-masker 250, the example network communicator 260, and/or, more generally, the example speech privacy engine 110 of FIGS. 1, 2, and/or 3 could be implemented by one or more circuit(s), programmable processor(s), application specific integrated circuit(s) (ASIC(s)), programmable logic device(s) (PLD(s)) and/or field programmable logic device(s) (FPLD(s)), etc. When any of the apparatus or system claims of this patent are read to cover a purely software and/or firmware implementation, at least one of the example audio receiver 210, the example masker 220, the example domain converter 310, the example frequency tracker 320, the example demodulator 330, the example distorter 340, the example distortion combiner 350, the example speaker 230, the example memory 240, the example de-masker 250, and/or the example network communicator 260 are hereby expressly defined to include a tangible computer-readable medium storage such as a memory, DVD, CD, Blu-ray, etc. storing the software and/or firmware. Further still, the example speech privacy engine 110 of FIGS. 1, 2, and/or 3 may include one or more elements, processes and/or devices in addition to, or instead of, those illustrated in FIGS. 1, 2, and/or 3, and/or may include more than one of any or all of the illustrated elements, processes and devices.

Figure 4:
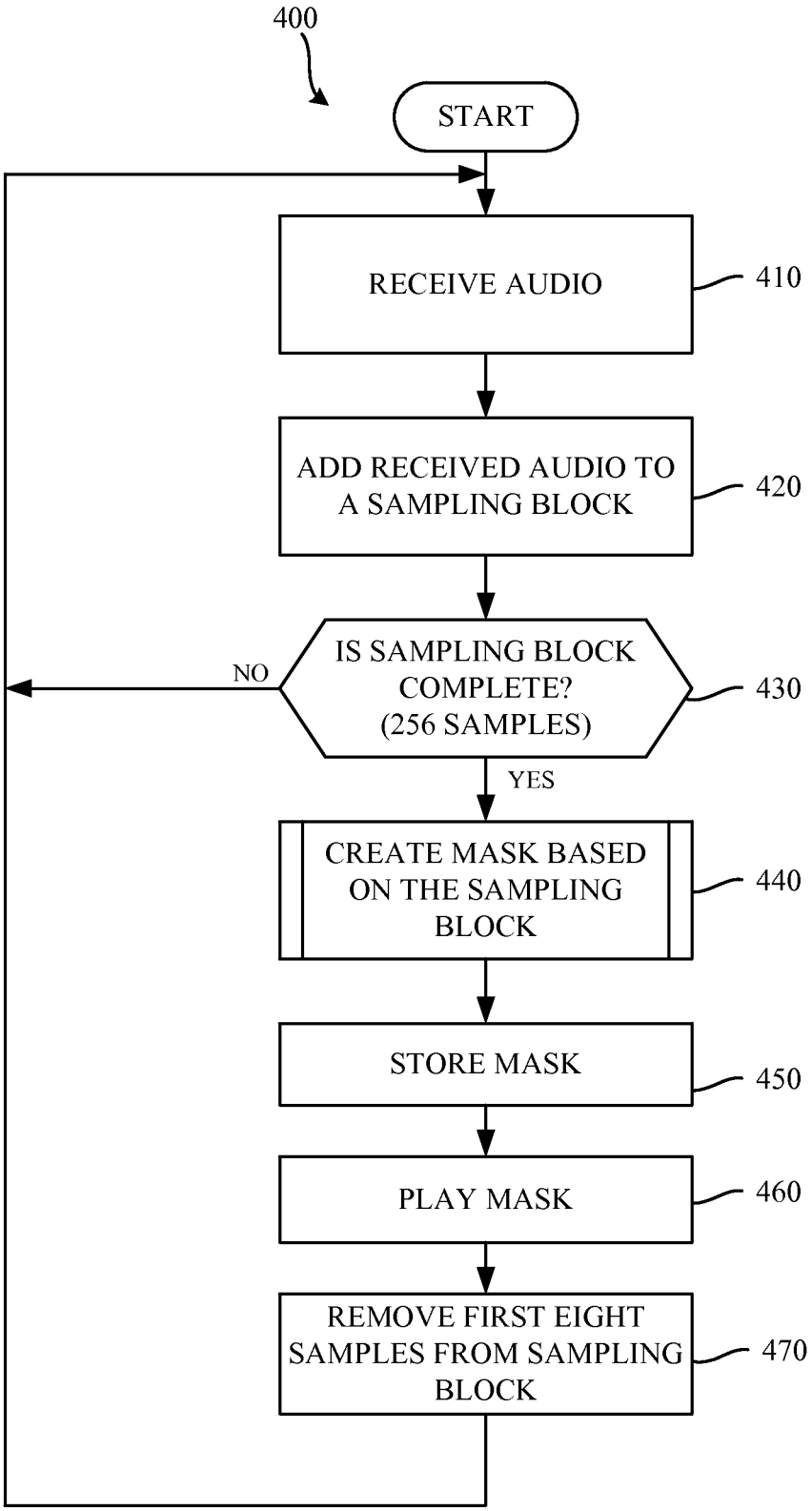
FIG. 4-6 are flowcharts representative of example machine-readable instructions that may be executed to provide speech privacy in a manner consistent with FIGS. 1 and/or 2.
Figure 5:
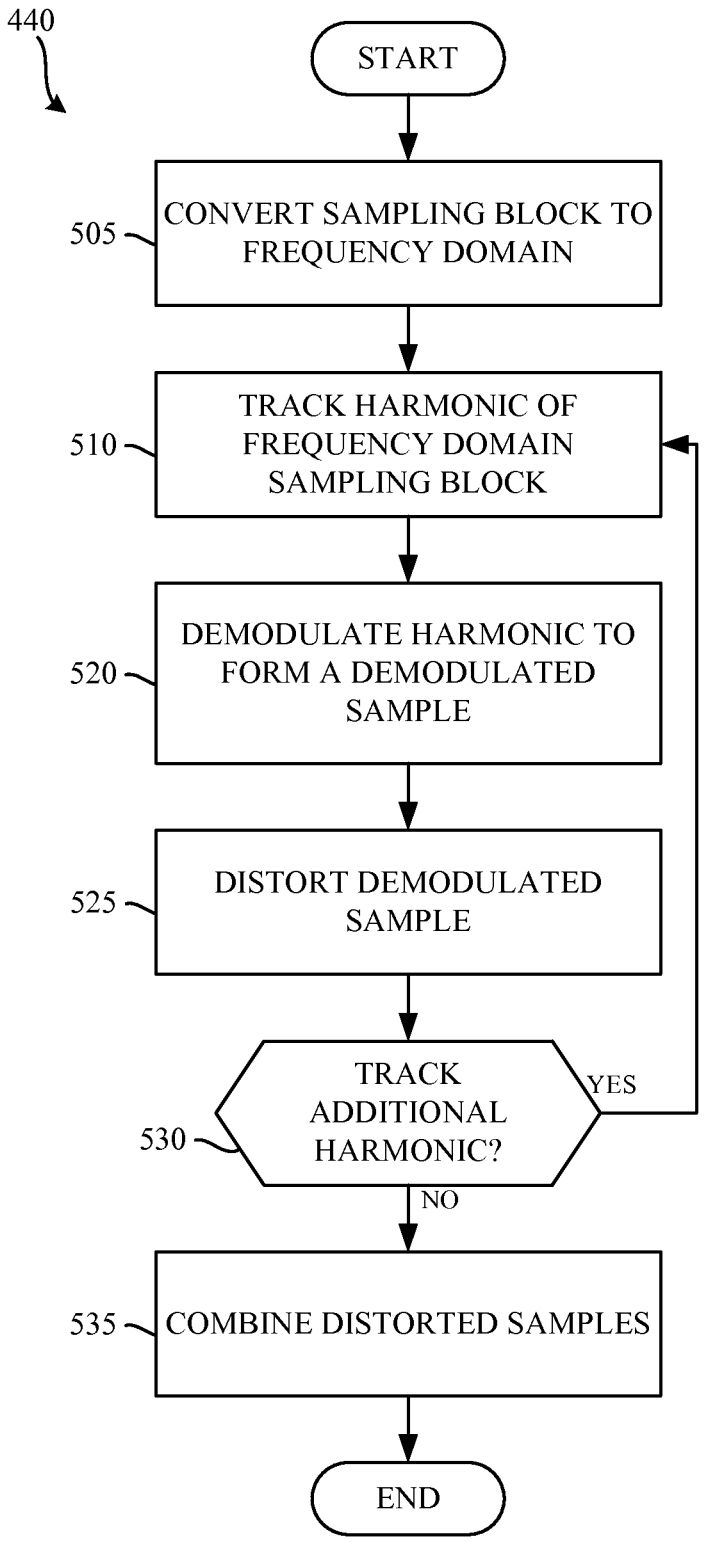

Flowcharts representative of example machine-readable instructions for implementing the speech privacy engine 110 of FIGS. 1, 2, and/or 3 are shown in FIGS. 4, 5, and/or 6. In these examples, the machine-readable instructions comprise program(s) for execution by a processor such as the processor 712 shown in the example processor platform 700 discussed below in connection with FIG. 7. The program(s) may be embodied in software stored on a tangible computer-readable storage medium such as a CD-ROM, a floppy disk, a hard drive, a digital versatile disk (DVD), a Blu-ray disk, or a memory associated with the processor 712, but the entire program and/or parts thereof could alternatively be executed by a device other than the processor 712 and/or embodied in firmware or dedicated hardware. Further, although the example program is described with reference to the flowcharts illustrated in FIGS. 4, 5, and/or 6, many other methods of implementing the example speech privacy engine 110 may alternatively be used. For example, the order of execution of the blocks may be changed, and/or some of the blocks described may be changed, eliminated, or combined.

As mentioned above, the example processes of FIGS. 4, 5, and/or 6 may be implemented using coded instructions (e.g., computer-readable instructions) stored on a tangible computer readable medium such as a computer-readable storage medium (e.g., a hard disk drive, a flash memory, a read-only memory (ROM), a compact disk (CD), a digital versatile disk (DVD), a cache, a random-access memory (RAM)) and/or any other storage device and/or storage disk in which information is stored for any duration (e.g., for extended time periods, permanently, brief instances, for temporarily buffering, and/or for caching of the information). As used herein, the term tangible computer-readable storage medium is expressly defined to include any type of computer-readable storage and to exclude propagating signals. Additionally or alternatively, the example processes of FIGS. 4, 5, and/or 6 may be implemented using coded instructions (e.g., computer-readable instructions) stored on a non-transitory computer-readable storage medium such as a hard disk drive, a flash memory, a read-only memory, a compact disk, a digital versatile disk, a cache, a random-access memory and/or any other storage device and/or storage disk in which information is stored for any duration (e.g., for extended time periods, permanently, brief instances, for temporarily buffering, and/or for caching of the information). As used herein, the term non-transitory computer-readable storage medium is expressly defined to include any type of computer-readable storage medium and to exclude propagating signals. As used herein, when the phrase "at least" is used as the transition term in a preamble of a claim, it is open-ended in the same manner as the term "comprising" is open ended. Thus, a claim using "at least" as the transition term in its preamble may include elements in addition to those expressly recited in the claim.

FIG. 4 is a flowchart representative of example machine-readable instructions 400 that may be executed to implement the example speech privacy engine 110 of FIGS. 1, 2, and/or 3. The example program of FIG. 4 begins when the acoustic audio receiver 210 receives audio (block 410). In some examples, the process of FIG. 4 may be executed when, for example, a user is speaking into the audio receiver 210 (e.g., a microphone) of the speech privacy engine 110. However, the example process of FIG. 4 may be additionally or alternatively executed in any other manner such as, for example, continuously, when a user enables the speech privacy engine 110, etc. The example audio receiver 210 samples the received audio. The example audio is sampled at 8 kHz (e.g., eight thousand samples per second, one sample every one hundred and twenty five microseconds). However, any other sampling rate may additionally or alternatively be used.

The received audio (in the form of the sample) is added to a sampling block by the masker 220 (block 420). In some examples, the sampling block may include a maximum of two hundred and fifty six samples in which the sampling block represents thirty-two milliseconds of audio received by the audio receiver 210. However, the sampling block may additionally or alternatively be any other length. In some examples, the sampling block may represent a rolling time window. That is, if the sampling block already contains the maximum number of samples, an existing sample within the sampling block is removed from the sampling block and the recently received sample is added to the sampling block. The removal of existing samples from the sampling block is described in more detail in connection with block 470.

The example masker 220 determines whether the sampling block is complete (block 430). In the illustrated example, the sampling block is complete when it contains two hundred and fifty six samples (e.g., the maximum size of the sampling block). However, in some examples, the sampling block may be complete when the sampling block contains fewer than the maximum number of samples. For example, the sampling block may be considered complete when it contains one hundred and twenty eight samples. If the sampling block is not complete (block 430), control proceeds to block 410 where additional samples are gathered until the sampling block is complete. If the sampling block is complete (block 430), the masker 220 creates an audio mask based on the sampling block (block 440). In some examples, the mask may have a length equivalent to eight samples. However, a mask having any other length may additionally or alternatively be used. The creation of the audio mask is described in more detail in connection with FIG. 5.

The example masker 220 stores the mask in the memory 240 of the speech privacy engine 110 (block 450). The example speaker 230 then begins playing back an acoustic representation of the mask generated by the masker 220 (block 460). In the illustrated example, the speaker 230 emits the acoustic representation of mask into the area surrounding the speech privacy engine 110, where the mask and audio received from the user is received by the example audio receiver 210.

The example masker 220 removes the first number (e.g., eight) samples from the sampling block (block 470). While in the illustrated example eight samples are removed, any other number of samples may additionally or alternatively be removed. Removing the first eight samples may include shifting the samples of the sampling block down eight consecutive times (iterations). Accordingly, what was previously the ninth sample becomes the first sample, and what was previously the two hundred and fifty sixth sample becomes the two hundred and forty eighth sample. The last eight samples (e.g., the two hundred and forty ninth to the two hundred and fifty sixth samples) are set to zero. In the illustrated example, the number of samples removed from the sampling block may correspond to the length of the mask generated by the masker 220. Accordingly, while the audio representation of the mask is played by the speaker 230, the audio receiver 210 and the masker 220 continue to build the sampling block until the sampling block is complete, as shown in blocks 410, 420, and 430. Once the speaker 230 completes playback of the audio representation of the mask, the sampling block will be complete, thereby causing the masker 220 to create another audio mask based on the sampling block (block 440). Because eight samples are removed from the sampling block, and the sampling rate is 8 kHz, a new mask is generated every millisecond.

FIG. 5 is a flowchart representative of example machine-readable instructions 440 that may be executed to implement the example masker 220 of FIGS. 2 and/or 3 of the example speech privacy engine 110 of FIGS. 1 and/or 2. The example program of FIG. 5 begins when the masker 220 of FIGS. 2 and/or 3 determines that the sampling block is complete (block 430). The example domain converter 310 of FIG. 3 converts the sampling block from the time domain to a frequency domain sampling block (block 505) and converts the sampling block from the time domain to the frequency domain using a short time Fourier transform (SFFT) function to perform the conversion. However any other method of converting the sampling block to the frequency domain sampling block may additionally or alternatively be used such as, for example, a discrete Fourier transform (DFT), a fast Fourier transform (FFT), a sparse fast Fourier transform (SFFT), etc.

The example frequency tracker 320 tracks a frequency of a harmonic of the frequency domain sampling block (block 510). However, any other point in the frequency domain sampling block may additionally or alternatively be used such as, for example, peaks other than harmonics, valleys, etc. The example frequency tracker 320 identifies one frequency at a time (e.g., additional frequencies may be identified if additional harmonics are to be tracked) (block 530). In the illustrated example, the identified harmonic is refined using a conditional mean frequency technique. However, any other method of refining the identification of the harmonic in the frequency domain sampling block may additionally or alternatively be used.

The example demodulator 330 demodulates the identified harmonic to create an envelope of the identified harmonic (block 520). In the illustrated example, the demodulator 330 demodulates the harmonic by using a Hilbert transform to obtain a complex amplitude associated with the harmonic. However, any other method of demodulating and/or transforming the frequency domain sampling block may additionally or alternatively be used. As a result of the demodulation, the frequency domain sampling block is filtered around the identified harmonic.

The example distorter 340 distorts the envelope of the identified harmonic to form a distorted harmonic (block 525). In the illustrated example, the distorter 340 distorts the envelope by introducing a phase shift at the same frequency and amplitude as the complex amplitude of the envelope of the identified harmonic. In the illustrated example, different phase shifts are introduced to different harmonics. However, in some examples, a same phase shift may be introduced to different harmonics. In some examples, the distortion applied to the envelope is based on a property of the envelope (e.g., a median frequency of the envelope, a peak amplitude of the envelope, etc.) Further, any other method of distorting the envelope of the identified harmonic may additionally or alternatively be used.

The example frequency tracker 320 determines whether additional harmonics are to be tracked (block 530). In the illustrated example, the first three harmonics of the frequency domain sampling block are tracked. Tracking the first three harmonics results in a speech mask that significantly reduces the intelligibility of the user to eavesdroppers. Using additional and/or fewer harmonics may increase and/or decrease, respectively, the amount of time taken to identify and/or track the harmonics. If additional harmonics are to be tracked, control proceeds to block 510. If no additional harmonics are to be tracked, the distortion combiner 350 combines the distorted harmonics created by the distorter 340 (block 535). The result of the combination is an audio mask in the time domain that sounds similar to the speech of the user. That is, the audio mask has similar speech formants, spectral characteristics, envelopes, etc. to the speech of the user.

Figure 6:
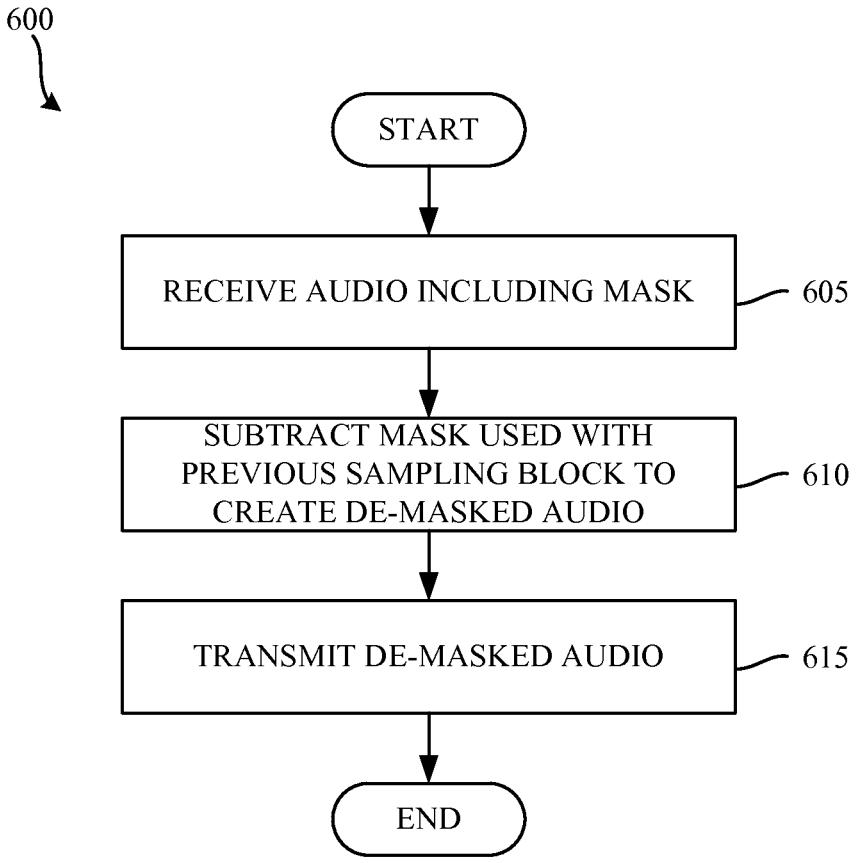

FIG. 6 is a flowchart representative of example machine-readable instructions that may be executed to implement the example speech privacy engine of FIGS. 1 and/or 2. The flowchart of FIG. 6 represents an example program that may be used to de-mask audio that is received via the audio receiver 210. The example program of FIG. 6 begins when audio is received via the audio receiver 210 (block 605). In the illustrated example, the audio received via the audio receiver 210 includes the audio mask emitted by the speaker 230. Accordingly, prior to transmitting the received audio, the de-masker 250 subtracts the mask associated with the previous sampling block from the received audio to create a de-masked sample (block 610). In the illustrated example, subtracting the mask further comprises cleaning the received audio using filtering and/or digital signal processing (DSP) techniques. In the illustrated example, the de-masker 220 cleans the audio to ensure that the audio is intelligible when recorded and/or transmitted to the calling partner 125. The de-masked audio is then transmitted (block 615). In the illustrated example, the de-masked audio is transmitted by the network communicator 260 to the calling partner 125. However, in other examples, the de-masked audio may be transmitted to the memory 240 for storage.

Figure 7:
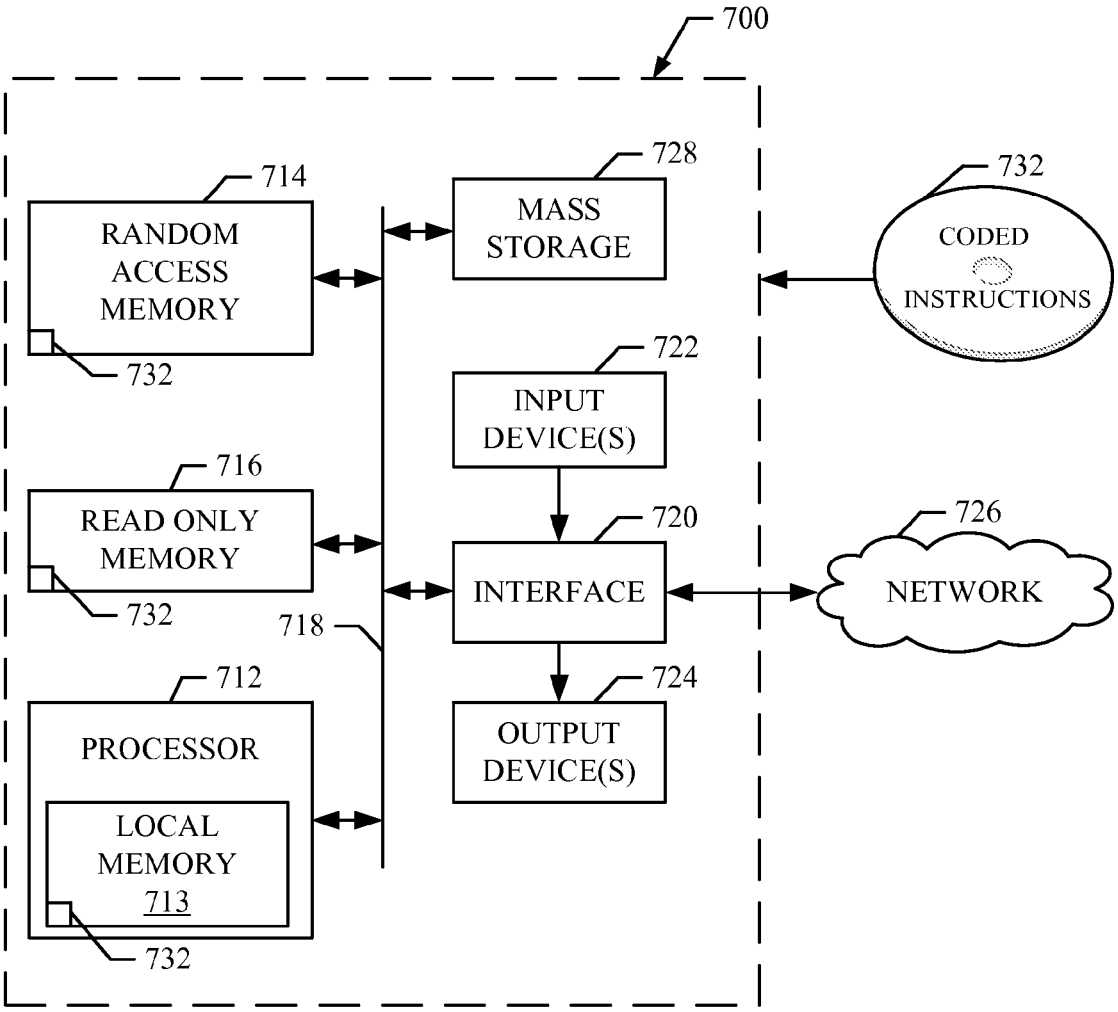
FIG. 7 is a block diagram of an example processor platform that may execute the machine-readable instructions of FIGS. 4, 5, and/or 6 to implement the example speech privacy engine of FIGS. 1 and/or 2.

FIG. 7 is a block diagram of an example processor platform 700 that may execute, for example, the machine-readable instructions of FIGS. 4, 5, and/or 6 to implement the example speech privacy engine 110 of FIGS. 1 and/or 2.

The processor platform 700 can be, for example, a server, a personal computer, a mobile phone (e.g., a cell phone), a personal digital assistant (PDA), a telephone, a digital voice recorder, or any other type of computing device.

The processor platform 700 of the instant example includes a processor 712. For example, the processor 712 can be implemented by one or more microprocessors or controllers from any desired family or manufacturer.

The processor 712 includes a local memory 713 (e.g., a cache) and is in communication with a main memory including a volatile memory 714 and a non-volatile memory 716 via a bus 718. The volatile memory 714 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 716 may be implemented by flash memory and/or any other desired type of memory device. Access to the main memory 714, 716 is controlled by a memory controller.

The processor platform 700 also includes an interface circuit 720. The interface circuit 720 may be implemented by any type of interface standard, such as an Ethernet interface, a universal serial bus (USB), and/or a PCI express interface.

One or more input devices 722 are connected to the interface circuit 720. The input device(s) 722 permit a user to enter data and commands into the processor 712. The input device(s) can be implemented by, for example, a keyboard, a mouse, a touchscreen, a track-pad, a trackball, isopoint and/or a voice recognition system.

One or more output devices 724 are also connected to the interface circuit 720. The output devices 724 can be implemented, for example, by display devices (e.g., a liquid crystal display, a cathode ray tube display (CRT), a printer and/or speakers). The interface circuit 720, thus, typically includes a graphics driver card.

The interface circuit 720 also includes a communication device (e.g., the network communicator 260) such as a modem or network interface card to facilitate exchange of data with external computers via a network 726 (e.g., an Ethernet connection, a digital subscriber line (DSL), a telephone line, coaxial cable, a cellular telephone system, etc.).

The processor platform 700 also includes one or more mass storage devices 728 for storing software and data. Examples of such mass storage devices 728 include floppy disk drives, hard drive disks, compact disk drives and digital versatile disk (DVD) drives. The mass storage device 728 may implement the memory 240.

The coded instructions 732 of FIGS. 4, 5, and/or 6 may be stored in the mass storage device 728, in the volatile memory 714, in the non-volatile memory 716, and/or on a removable storage medium such as a CD or DVD.

An example method to provide speech privacy includes forming a sampling block based on a first received audio sample, the sampling block representing speech of a user. A mask is created based on the sampling block. The mask reduces the intelligibility of the speech of the user. The example mask is created by: converting the sampling block from a time domain to a frequency domain to form a frequency domain sampling block; identifying a first peak within the frequency domain sampling block; demodulating the frequency domain sampling block at the first peak to form a first envelope of the sampling block; and distorting the first envelope to form a first distorted envelope. An acoustic representation of the mask is emitted via a speaker.

In some examples, the method further includes subtracting the mask from a second received audio sample to form a third audio sample, the second audio sample representing the speech of the user plus the mask.

In some examples, the method further includes transmitting the third audio sample to a calling partner.

In some examples, the method further includes storing the third audio sample in a memory.

In some examples, the method further includes storing the mask in a memory.

In some examples, the method further includes identifying a second peak within the frequency domain sampling block; demodulating the frequency domain sampling block at the second peak to form a second envelope of the sampling block; distorting the second envelope to form a second distorted envelope; and combining the first distorted envelope and the second distorted envelope.

In some examples, distorting the first envelope includes adding a first phase shift to the first envelope; and distorting the second envelope includes adding a second phase shift to the second envelope.

In some examples, the first phase shift is different from the second phase shift.

In some examples, converting the sampling block is implemented using a short time Fourier transform.

In some examples, the first peak represents a first harmonic of the sampling block.

In some examples, distorting the first envelope comprises adding a phase shift to the first envelope.

An example speech privacy apparatus includes an audio receiver to receive speech from a user; a masker to create an audio mask based on the speech from the user, the audio mask to reduce an intelligibility of the speech of the user. In some examples, the masker includes a domain converter to convert the speech received from the user into a frequency domain sampling block; a frequency tracker to identify a first peak within the frequency domain sampling block; a demodulator to demodulate the frequency domain sampling block at the first peak to form a first envelope; and a distorter to distort the first envelope to form a first distorted envelope. In some examples, the speech privacy apparatus includes a speaker to emit an acoustic representation of the audio mask.

In some examples, the audio receiver is to receive the speech from the user and the audio mask emitted from the speaker as a second audio sample. In some examples, the speech privacy apparatus further includes a memory to store the audio mask; and a de-masker to subtract the audio mask stored in the memory from the second audio sample to form a clean speech sample.

In some examples, the speech privacy apparatus includes a network communicator to transmit the clean speech sample to a calling partner.

In some examples, the de-masker is to store the clean speech sample in the memory.

An example tangible computer-readable storage medium comprises instructions which, when executed, cause a machine to at least form a sampling block based on a first received audio sample, the sampling block representing speech of a user; create a mask based on the sampling block, the mask to reduce the intelligibility of the speech of a user. In some examples, the mask is created by converting the sampling block from a time domain to a frequency domain to form a frequency domain sampling block; identifying a first peak within the frequency domain sampling block; demodulating the frequency domain sampling block at the first peak to form a first envelope of the sampling block; and distorting the first envelope to form a first distorted envelope. The example instructions cause the machine to emit an acoustic representation of the mask via a speaker.

Some example computer-readable storage mediums include instructions to subtract the mask from a second received audio sample to form a third audio sample, the second audio sample representing the speech of the user plus the mask.

Some example computer-readable storage mediums include instructions to transmit the third audio sample to a calling partner.

Some example computer-readable storage mediums include instructions to store the third audio sample in a memory.

Some example computer-readable storage mediums include instructions to store the mask in a memory.

Some example computer-readable storage mediums include instructions to identify a second peak within the frequency domain sampling block; demodulate the frequency domain sampling block at the second peak to form a second envelope of the sampling block; distort the second envelope to form a second distorted envelope; and combine the first distorted envelope and the second distorted envelope.

Some example computer-readable storage mediums include instructions to distort the first envelope by adding a first phase shift to the first envelope; and distort the second envelope by adding a second phase shift to the second envelope.

In some examples, the first phase shift is different from the second phase shift.

In some examples, the sampling block is implemented using a short time Fourier transform.

In some examples, the first peak represents a first harmonic of the sampling block.

In some examples, distorting the first envelope includes adding a phase shift to the first envelope.

From the foregoing, it will appreciate that the above-disclosed methods, apparatus, and articles of manufacture enable masking of speech from a user, thereby providing privacy to the user.

What is claimed is:

1. A method to provide speech privacy, comprising:

forming a sampling block based on a first received audio sample, the sampling block representing speech of a user;

creating, with a processor, a mask based on the sampling block, the mask to reduce the intelligibility of the speech of the user, wherein the mask is created by:

converting the sampling block from a time domain to a frequency domain to form a frequency domain sampling block;

identifying a first peak within the frequency domain sampling block;

demodulating the frequency domain sampling block at the first peak to form a first envelope of the sampling block;

distorting the first envelope by introducing a first phase shift to the first envelope to form a first distorted envelope;

identifying a second peak within the frequency domain sampling block;

demodulating the frequency domain sampling block at the second peak to form a second envelope of the sampling block;

distorting the second envelope by introducing a second phase shift to the second envelope to form a second distorted envelope; and combining the first distorted envelope and the second distorted envelope to create the mask; and emitting an acoustic representation of the mask via a speaker.

2. The method of claim 1, further including subtracting the mask from a second received audio sample to form a third audio sample, the second audio sample representing the speech of the user plus the mask.

3. The method of claim 2, further including transmitting the third audio sample to a calling partner.

4. The method of claim 2, further including storing the third audio sample in a memory.

5. The method of claim 1, further including storing the mask in a memory.

6. The method of claim 1, wherein the first phase shift is different from the second phase shift.

7. The method of claim 1, wherein converting the sampling block is implemented using a short time Fourier transform.

8. The method of claim 1, wherein the first peak represents a first harmonic of the sampling block.

9. A speech privacy apparatus comprising:

an audio receiver to receive speech from a user;

a masker to create an audio mask based on the speech from the user, the audio mask to reduce an intelligibility of the speech of the user, the masker including:

a domain converter to convert the speech received from the user into a frequency domain sampling block;

a frequency tracker to identify a first peak within the frequency domain sampling block, the frequency tracker to identify a second peak within the frequency domain sampling block;

a demodulator to demodulate the frequency domain sampling block at the first peak to form a first envelope, the demodulator to demodulate the frequency domain sampling block at the second peak to form a second envelope of the sampling block;

a distorter to introduce a first phase shift to the first envelope to form a first distorted envelope, the distorter to introduce a second phase shift to the second envelope to form a second distorted envelope;

a distortion combiner to combine the first distorted envelope and the second distorted envelope to create the mask; and a speaker to emit an acoustic representation of the audio mask.

10. The speech privacy apparatus of claim 9, wherein the audio receiver is to receive the speech from the user and the audio mask emitted from the speaker as a second audio sample, and further including:

a memory to store the audio mask; and a de-masker to subtract the audio mask stored in the memory from the second audio sample to form a clean speech sample.

11. The speech privacy apparatus of claim 10, further including a network communicator to transmit the clean speech sample to a calling partner.

12. The speech privacy apparatus of claim 10, wherein the de-masker is to store the clean speech sample in the memory.

13. A tangible computer-readable storage medium comprising instructions which, when executed, cause a machine to at least:

form a sampling block based on a first received audio sample, the sampling block representing speech of a user;

create a mask based on the sampling block, the mask to reduce the intelligibility of the speech of the user, wherein the mask is created by:

converting the sampling block from a time domain to a frequency domain to form a frequency domain sampling block;

identifying a first peak within the frequency domain sampling block;

demodulating the frequency domain sampling block at the first peak to form a first envelope of the sampling block;

distorting the first envelope by introducing a first phase shift to the first envelope to form a first distorted envelope;

identifying a second peak within the frequency domain sampling block;

demodulating the frequency domain sampling block at the second peak to form a second envelope of the sampling block;

distorting the second envelope by introducing a second phase shift to the second envelope to form a second distorted envelope; and combining the first distorted envelope and the second distorted envelope to create the mask; and emit an acoustic representation of the mask via a speaker.

14. The tangible computer-readable storage medium of claim 13, wherein the instructions, when executed, cause the machine to subtract the mask from a second received audio sample to form a third audio sample, the second audio sample representing the speech of the user plus the mask.

15. The tangible computer-readable storage medium of claim 14, wherein the instructions, when executed, cause the machine to transmit the third audio sample to a calling partner.

16. The tangible computer-readable storage medium of claim 14, wherein the instructions, when executed, cause the machine to store the third audio sample in a memory.

17. The tangible computer-readable storage medium of claim 13, wherein the instructions, when executed, cause the machine to store the mask in a memory.

18. The tangible computer-readable storage medium of claim 13, wherein the first phase shift is different from the second phase shift.

19. The tangible computer-readable storage medium of claim 13, wherein the instructions cause the machine to convert the sampling block is implemented using a short time Fourier transform.

20. The tangible computer-readable storage medium of claim 13, wherein the first peak represents a first harmonic of the sampling block.

* * * * *